US011117399B2

(12) United States Patent
Terradellas Callau et al.

(10) Patent No.: US 11,117,399 B2
(45) Date of Patent: Sep. 14, 2021

(54) SUBSTRATE DE-SKEW IN PRINTING SYSTEMS

(71) Applicant: Hewlett-Packard Development Company, L.P., Spring, TX (US)

(72) Inventors: Roger Terradellas Callau, Sant Cugat del Valles (ES); Francisco Javier Rodriguez Escanuela, Sant Cugat del Valles (ES); Daniel Gutierrez Garcia, Sant Cugat del Valles (ES); Brian Carvajal, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/488,893

(22) PCT Filed: Jun. 12, 2017

(86) PCT No.: PCT/US2017/037022
§ 371 (c)(1),
(2) Date: Aug. 26, 2019

(87) PCT Pub. No.: WO2018/231192
PCT Pub. Date: Dec. 20, 2018

(65) Prior Publication Data

US 2020/0062011 A1 Feb. 27, 2020

(51) Int. Cl.
*B41J 13/00* (2006.01)

(52) U.S. Cl.
CPC ..... *B41J 13/0009* (2013.01)

(58) Field of Classification Search
CPC ..... B41J 11/007; B41J 11/005; B41J 11/001; B41J 13/02; B41J 13/0009; B41J 15/048; B41J 11/0085
See application file for complete search history.

(56) References Cited

U.S. PATENT DOCUMENTS

| | | | |
|---|---|---|---|
| 7,393,096 | B2 | 7/2008 | Takagi |
| 7,706,731 | B2 | 4/2010 | Martin et al. |
| 8,840,241 | B2 | 9/2014 | Fletcher et al. |
| 8,944,585 | B2 | 2/2015 | Hirai et al. |
| 2016/0159114 | A1 | 6/2016 | Takenaka et al. |
| 2017/0087885 | A1 | 3/2017 | Lyon et al. |

FOREIGN PATENT DOCUMENTS

| | | |
|---|---|---|
| EP | 3124264 | 2/2017 |
| EP | 3159172 | 4/2017 |
| WO | WO-2016008597 | 1/2016 |

OTHER PUBLICATIONS

Hybrid Eco Solvent Printer Mt-R180e (Roll to Roll & Flatbed) < http://ksign.co.in/hybrid-eco-solvent-printer-mt-r180e-roll-to-roll-flatbed/ >.

*Primary Examiner* — Jannelle M Lebron
(74) *Attorney, Agent, or Firm* — HP Inc. Patent Department

(57) ABSTRACT

Aspects of the present disclosure relate to a printing system. In one example, the printing system comprises a print substrate supply mechanism and a conveyor belt. The print substrate supply mechanism is to supply print substrate to the conveyor belt and the conveyor belt is to advance the supplied print substrate. During a substrate loading operation of the printing system, the print substrate supply mechanism prevents motion of the substrate such that when the conveyor belt is activated the supplied substrate slides over the conveyor belt.

13 Claims, 4 Drawing Sheets

1A:

1B:

SUBSTRATE DE-SKEW IN PRINTING SYSTEMS

BACKGROUND

Some printers include a conveyor belt to support and move printing substrate in coordination with printing components to produce a printed product. The printing substrate is supplied to the conveyor belt from a print substrate supply mechanism.

BRIEF DESCRIPTION OF THE DRAWINGS

Various features of the present disclosure will be apparent from the detailed description which follows, taken in conjunction with the accompanying drawings, which together illustrate, features of certain examples, and where.

DETAILED DESCRIPTION

Figure 1:
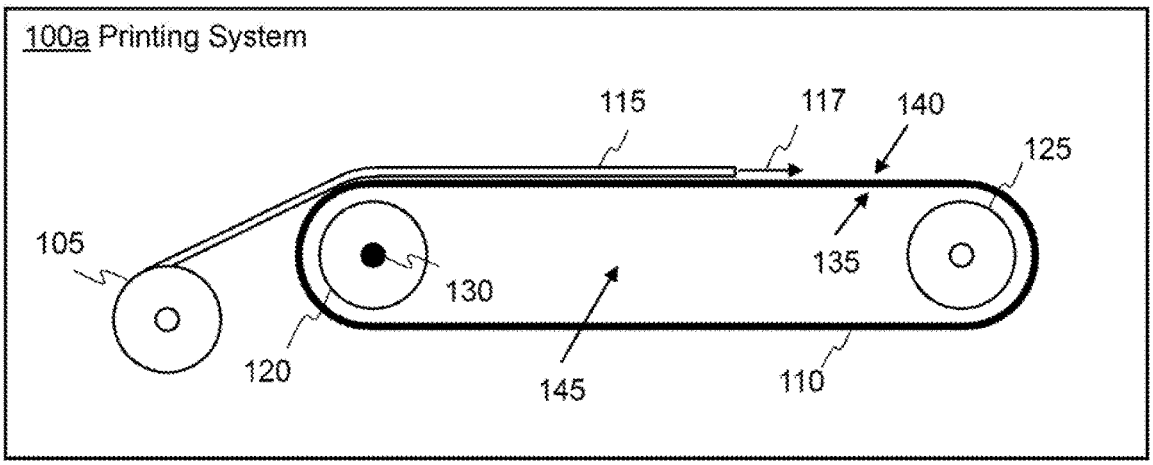
FIGS. 1A and 1B show schematic representations of printing systems according to examples.
Figure 1:
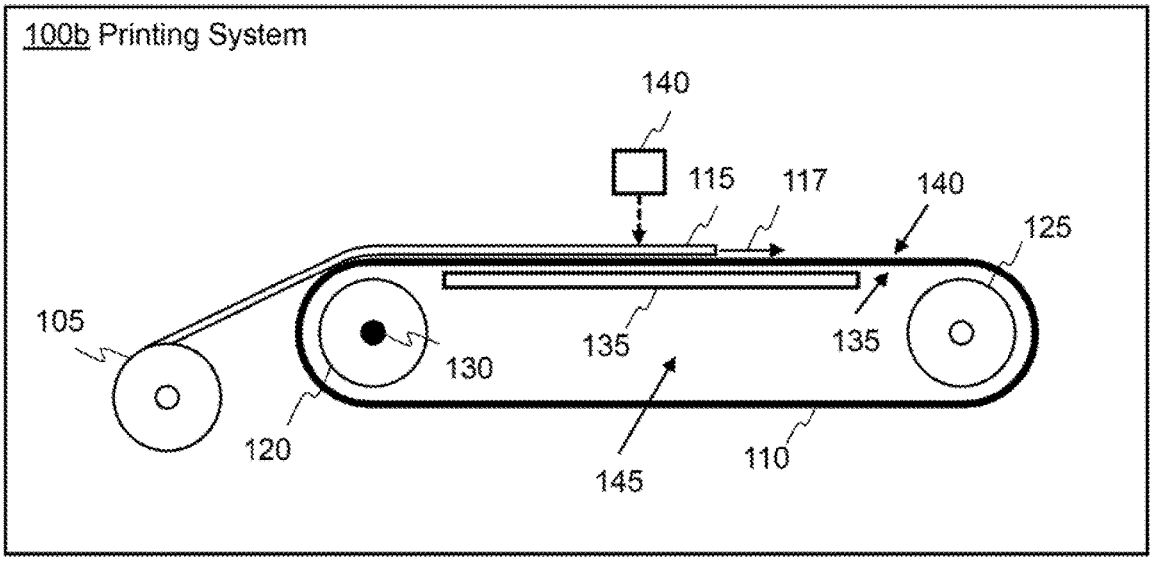

Certain examples described herein relate to printing systems with a conveyor belt to advance rigid or flexible print substrate, onto which an image is printed. In some examples, the printing system is a two-dimensional (2D) printing system such as an inkjet or digital offset printer. In these examples, the print substrate may comprise paper, cardstock, boards, metal sheet, plastic sheet, and the like. The printing system may be a large format printer for printing signs, billboards and/or other displays in latex-based inks. A sheet of print substrate rests on top of the conveyor belt and is driven through a print zone. In the print zone, an image is printed onto the substrate, for example by applying printing fluid using inkjet print heads mounted above the conveyor belt. In other examples, the printing system is a three-dimensional (3D) printing system, otherwise known as an additive manufacturing system. In these examples, the print substrate may comprise a build material. For example, the build material may be deposited on top of the conveyor belt and be driven through the additive manufacturing system. Some additive manufacturing systems use a "layer-by-layer" approach, where a solidification process is applied to each layer of deposited build material before the next layer of build material is applied. Various methods can be used to secure the print substrate to the conveyor belt. For example, a vacuum mechanism may be used to secure the print substrate to the conveyor belt via suction.

In such printing systems, misalignment can occur between the printing substrate and the conveyor belt. For example, this misalignment may be introduced by a user when loading substrate into the printing system. Such misalignment can lead to skew and/or wrinkles in the print substrate, which can in turn cause defects in the printed product, damage to print zone components such as print heads, and can make it difficult to print on certain substrate types. This can waste material resources and also reduce printer up-time as a print job is restarted and/or print heads are replaced.

Some approaches to reducing substrate misalignment comprise improving accuracy and tolerances of system components. Other approaches comprise assisting the user in accurately loading substrate. Further approaches comprise applying tension to the substrate as it is provided to the conveyor belt during printing, in order to reduce the incidence of wrinkles. However, such approaches may be unable to eliminate, or to sufficiently reduce, misalignment, in particular over the course of a long print run. Other approaches include adding additional rollers between a substrate supply and the conveyor belt. This adds complexity to the substrate path and loading procedure and also increases waste of substrate, as well as being unable to sufficiently reduce misalignment.

Certain examples described herein act to reduce or eliminate the above-described misalignment between the print substrate and the conveyor belt. Certain examples will now be described with reference to the Figures.

FIGS. 1A and 1B show schematic representations of printing systems 100*a*, 100*b* according to examples. Referring to FIG. 1A, the printing system 100*a* comprises a print substrate supply mechanism 105. In some examples, the print substrate supply mechanism 105 comprises a roll for supplying flexible print substrate. Examples of flexible substrate include paper and flexible plastic. Such a roll may comprise flexible substrate wound around a core, to enable longer print runs and compact storage.

The printing system 100*a* further comprises a conveyor belt 110. The print substrate supply mechanism 105 supplies print substrate 115 to the conveyor belt 110. The conveyor belt is to advance the supplied print substrate in a conveyance direction 117. The conveyor belt 110 may include a loop or band of material with sufficient flexibility to bend or deform around rollers for moving the conveyor belt. In some examples, the conveyor belt 110 can include segmented rigid or semi-rigid sections coupled to one another by hinged connectors.

In some examples, the conveyor belt 110 is disposed around a drive roller 120 and an idle roller 125. The drive roller 120 may comprise a drive mechanism 130, for example a motor or a motorized shaft, for turning the drive roller 120. In turn, the drive roller 120 can apply a force to the conveyor belt 110 that causes it to move about the rollers 120, 125. As such, rotational movement of the drive roller 120 can be translated into corresponding linear motion of the conveyor belt 110. The linear motion of the conveyor belt 110 can then be used to move material disposed thereon.

In examples, the conveyor belt 110 is elongate with a length in the conveyance direction 117 that the conveyor belt 110 moves in, and a lateral dimension or width in a direction perpendicular to the conveyance direction 117. The length may be larger than the width.

The conveyor belt 110 has an interior surface 135 and an exterior surface 140. The exterior surface 140 is as a surface on which print substrate 115 is carried. In examples, the print substrate is held to the exterior surface 140 by gravity, friction, clamps, and/or vacuum. The interior surface 135 may be considered the surface of the conveyor belt 110 in contact with or disposed in proximity to the rollers on which the conveyor belt moves. As such, the conveyor belt 110 can define an interior and exterior relative to the conveyor belt 110. For example, the region within the confines of the loop of the conveyor belt 110 and proximate to the interior surface 135 of the conveyor belt 110 can be referred to herein as the conveyor belt interior 145.

In some examples, in which the substrate supply mechanism 105 comprises a roll of substrate, the roll is received by a rotatable shaft of the substrate supply mechanism 105. During printing, the rotatable shaft unwinds the roll at the speed of the conveyor belt 110, for example by way of a servo controlling the rotation or by way of the substrate being pulled by the conveyor belt 110. In some examples, the printing system 100 comprises a substrate position indicator to indicate a loading position for the substrate 115. In one such example, a user loads a roll of substrate onto the aforementioned rotatable shaft and inflates pneumatic lugs to lock the roll onto the shaft. The user then partially unrolls the substrate 115 onto the conveyor belt 110. The substrate position indicator, for example an alignment bar or reference mark, serves to indicate an approximate suitable position for the leading edge of the substrate 115. As will be described, the printing system 100*a* is capable of successfully loading and printing onto the substrate 115, despite inaccuracies in the user's positioning of the substrate 115.

Referring to FIG. 1B, the printing system 100*b* comprises the elements described above in relation to FIG. 1A. The printing system 100*b* further comprises a print platen 135 within the conveyor belt interior 145 and proximate to the interior surface 135 of the conveyor belt 110. The print platen 135 provides a flat surface to support the substrate 115 during printing.

The printing system 100*b* comprises printing elements 140, for example including a print head or print heads for applying printing material or printing fluid, such as ink, to the substrate 115. In some examples, the printing elements 140 move laterally during printing as the conveyor belt 110 moves intermittently in the conveyance direction 117. In other examples, the printing elements 140 are static and extend over the width of the substrate 115 onto which printing is performed.

The following description applies to the printing systems 100*a,b* of FIGS. 1A and 1B. The printing system 100*a,b* performs a substrate loading operation, in which substrate 115 is loaded for printing. During such a substrate loading operation of the printing system 100*a,b*, the print substrate supply mechanism 105 prevents motion of the substrate 115 such that when the conveyor belt 110 is activated, the supplied substrate 115 slides over the conveyor belt 110. In some examples, the substrate supply mechanism 105 prevents motion of the substrate 115 by engaging a locking element. For example, where the substrate supply mechanism comprises a roll of flexible substrate, the locking mechanism may comprise a brake preventing rotation of the roll. In other examples, the locking mechanism acts directly on the substrate 115, for example by clamping the substrate 115 to prevent motion.

Alternatively or additionally, as noted above, in some examples where the substrate supply mechanism 105 comprises a shaft for receiving a roll of substrate, the shaft is rotatable by a servo. Motion of the substrate 115 can be prevented by the substrate supply mechanism 105 controlling the servo to prevent such motion.

As such, during the loading operation, motion of the substrate 115 is prevented and the conveyor belt 110 is activated to rotate in the conveyance direction 117. As the substrate 115 is prevented from moving, the conveyor belt 110 slides underneath the substrate. This has an effect of aligning the substrate 115. For example, a skew and/or wrinkle in the substrate 115 can be introduced by the user when inserting the substrate 115 into the printing system 100*a,b*. Similarly, a skew may be caused by a misalignment between the substrate supply mechanism 105 and the conveyor belt 110, for example a misalignment between a shaft of the substrate supply mechanism 105 and the first roller 130 of the conveyor belt 110. As noted above, such wrinkles and skew can cause damage to print heads and defects in the printed image, for example resulting from ink smearing against a print head. The friction of the conveyor belt 110 sliding underneath the substrate 115, according to examples described herein, acts to direct the substrate 115 into the correct alignment and, in doing so, reduces or eliminates this skew and/or wrinkle. By use of examples, the loading operation is thus not dependent on the user achieving accurate alignment while loading the substrate 115. As a consequence, the correcting of the alignment does not include the user repeating the loading process. This minimizes user intervention and decreases the time to load the substrate 115 into the printing system 100*a,b*, which maximizes the effective up-time of the printing system 100*a,b*. This also allows long print runs, for example printing an entire roll of substrate 115 without requiring manual alignment correction. As noted above, the improved alignment also reduces the risk of damaging the print system 100*a,b*, for example by removing the risk of a print head striking a raised wrinkle in the substrate 115.

In an example, the substrate supply mechanism 105 allows motion of the substrate during a printing operation of the printing system 100*a,b*. For example, where motion of the substrate 115 during the loading operation is prevented by engaging a locking element, this locking element is disengaged during the printing operation. Similarly, where motion of the substrate 115 is prevented during the loading operation by controlling a servo to prevent such motion, the servo is controlled during the printing operation such that substrate moves from the supply mechanism 105 onto the conveyor belt 110. As such, when the conveyor belt 110 is activated during the printing operation, the supplied substrate 115 is advanced by the conveyor belt 110.

It may be desirable for the substrate 115 to have a particular tension during a printing operation. An optimum tension is sufficiently high to provide a stable printing surface whilst not being so high as to warp, tear or otherwise damage the substrate 115. Although the loading process may induce a tension in the substrate 115, this may not be the optimum tension. In some examples, after the substrate loading operation and prior to a printing operation of the printing system 100*a,b*, the substrate supply mechanism 105 applies a tensioning force to the supplied substrate to set tension of the substrate to a tension suitable for the printing operation. In one such example, following the loading operation, motion of the substrate 115 is allowed, for example by releasing the aforementioned locking element. Substrate tension induced during the loading operation is thus released. The substrate supply mechanism 105 then applies a force to the substrate 115, in a direction opposite to the conveyance direction 117. For example, where the substrate supply mechanism 105 comprises a roll of substrate, the roll may be rotated away from the conveyor belt 110, i.e. in a "rewinding" direction, to provide the tension. In some examples, applying a tensioning force in this manner allows improved control of the substrate tension.

Figure 2:
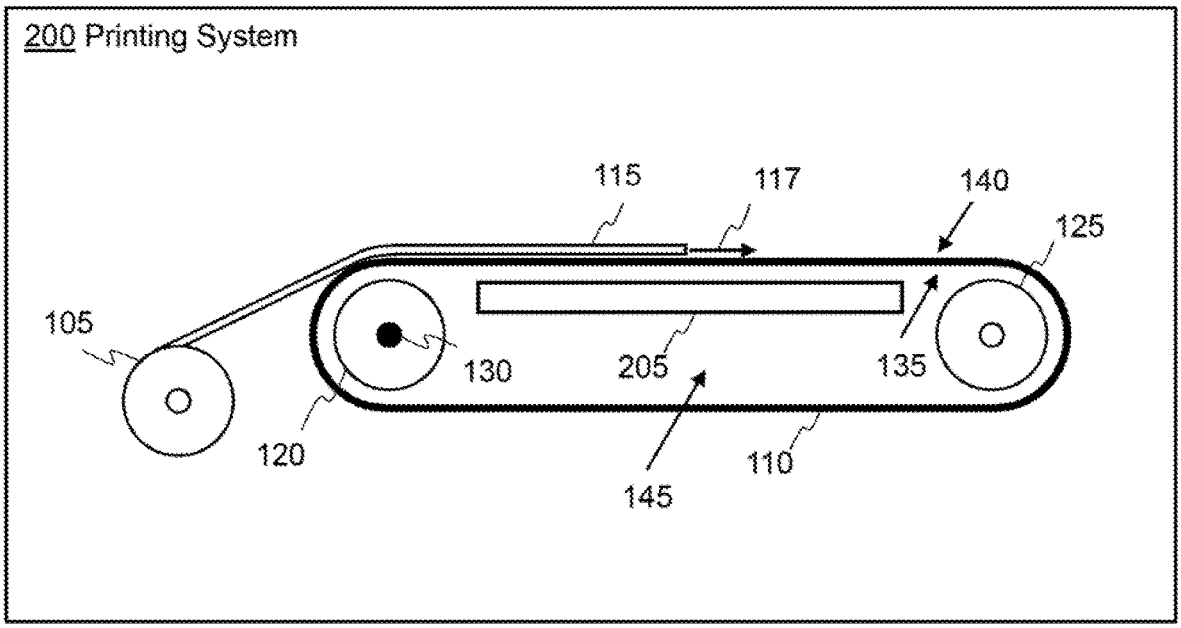
FIG. 2 is a schematic representation of a printing system according to an example.

FIG. 2 shows a schematic representation of a printing system 200 according to an example. The printing system 200 comprises a print substrate supply mechanism 105 that supplies substrate 115 to a conveyor belt 110. The conveyor belt runs, in a conveyance direction 117, over rollers 120, 125. These components operate as set out above in relation to FIG. 1A.

The printing system 205 further comprises a pressure application mechanism 205 to maintain the supplied substrate against the conveyor belt. In some examples, the pressure application mechanism 205 comprises a vacuum pump, positioned in the interior 145 of the conveyor belt 110, to exert vacuum pressure on the substrate 115 to maintain the substrate 115 in place against the conveyor belt 110. In such examples, the conveyor belt 110 can include openings, channels, or holes through which the vacuum pump can apply the vacuum to the substrate 115. In other examples, the pressure application mechanism comprises another type of pressure source, such as a pump or other element to press the substrate 115 onto the conveyor belt 115 from above. The pressure application mechanism 205 can thus provide a force that increases the friction between the substrate 115 and the exterior surface 140 of the conveyor belt 110.

During the substrate loading operation, the pressure application mechanism 205 applies a first pressure such that when the conveyor belt 110 is activated, the supplied substrate 115 slides over the conveyor belt. In other words, the pressure application mechanism 205 applies a pressure that is sufficiently high to maintain the substrate 115 against the conveyor belt 110, but not so high that the substrate 115 is prevented from sliding over the conveyor belt 110. The first pressure can be set to optimize the alignment correction. In one example, the first pressure is 50 Pascals.

In some examples, during a printing operation of the printing system 200, the pressure application mechanism 205 applies a second pressure, different from the first pressure. The second pressure is such that when the conveyor belt 110 is activated, the supplied substrate 115 is advanced by the conveyor belt. The second pressure is thus sufficiently high as to prevent the substrate 115 disposed on the exterior surface 140 of the conveyor belt 110 from sliding as the conveyor belt 110 moves. As such, when the conveyor belt 110 moves, the substrate 115 also moves with no sliding, curling, or lifting. In one example, the second pressure is set to 750 Pascals.

Figure 3:
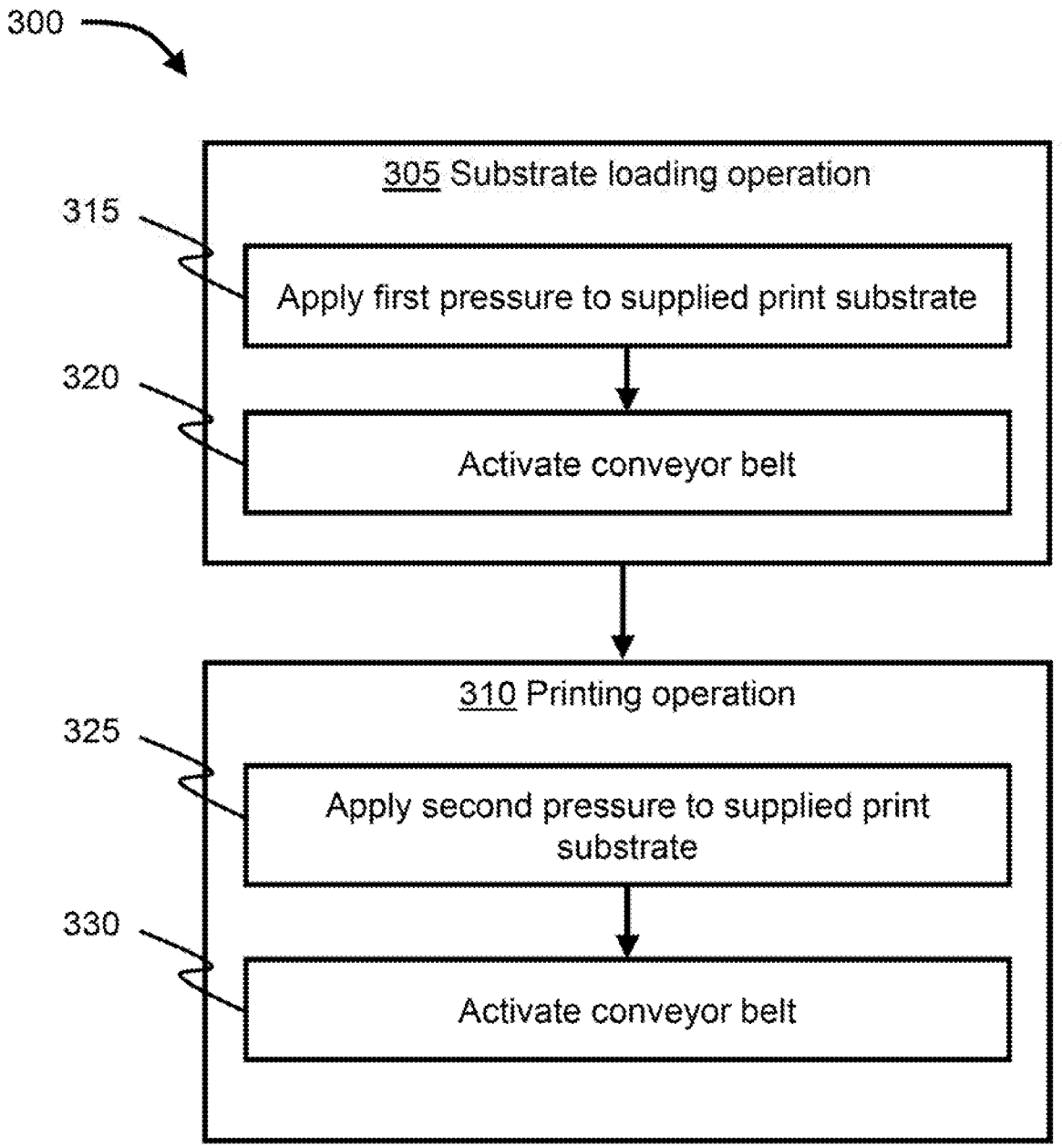
FIG. 3 shows a method of operating a printing system according to an example.

FIG. 3 shows a schematic representation of a method 300 of operating a printing system 200 according to an example. As described above, the printing system 200 comprises a print substrate supply mechanism 105 to supply print substrate 115 to a conveyor belt 110. The conveyor belt 110 is to advance the supplied print substrate 115.

The method 300 comprises performing a substrate loading operation 305 of the printing system 200 and performing a printing operation 310 of the printing system 200. In examples, the substrate loading operation is initiated by a user, via an interface of the printing system 200, after inserting substrate into the substrate supply mechanism 105. In some examples the interface is a physical interface, for example comprising a keypad mounted onto or communicatively coupled with the printing system 200. In other examples, the interface is a software interface accessed for example via a computer connected to the printing system 200 by a network. In some such examples, the substrate loading operation 305 and printing operation 310 are performed in response to a user initiating a print job. This allows, for example, a print job to be performed in response to a single command from the user, with substrate misalignment being corrected without requiring separate user input. The efficiency of the printing process is thus improved.

The substrate loading operation 305 comprises applying 315 a first pressure, for example a vacuum pressure, to the supplied print substrate 115 to cause the supplied print substrate 115 to remain against the conveyor belt 110. In an example, the first pressure is a applied by a pressure application mechanism 205, for example comprising a vacuum pump, as described above in relation to FIG. 2. In one example, the first pressure is between 5% and 10% of a second pressure, applied during the printing operation 310 as described below. For example, the first pressure may be 50 Pascals.

The substrate loading operation 305 then comprises activating 320 the conveyor belt 110. The first pressure allows the supplied substrate 115 to slide over the conveyor belt 110, thereby correcting misalignment as described in more detail above in relation to FIGS. 1A, 1B and 2. In one example, the conveyor belt 110 is activated to advance 500 millimetres at 3 inches per second. The conveyor belt 110 is then deactivated.

The printing operation 310 comprises applying 325 a second pressure, for example a vacuum pressure, to the supplied print substrate 115. The second pressure causes the supplied print substrate 115 to remain against the conveyor belt 110. In an example, the first pressure is applied by a pressure application mechanism 205, for example comprising a vacuum pump, as described above in relation to FIG. 2. The second pressure is different from the first pressure. In one example, the second pressure is around 15 times the first pressure to ensure proper binding to the conveyor belt 110, for example 750 Pascals.

The printing operation 310 then comprises activating 330 the conveyor belt 110. The second pressure is such that the supplied substrate 115 is advanced by the conveyor belt 110. The printing system 200 is thus able to print onto the correctly-aligned substrate 115. In some examples, instead of deactivating the conveyor belt 110 following the first activation 320, the conveyor belt is activated 320 following application 315 of the first pressure and remains activated during the printing operation 310.

In examples, the substrate loading operation 305 comprises preventing motion of the substrate 115, for example by preventing motion of the substrate supply mechanism 105 as described above. In such examples, the printing operation 310 comprises allowing motion of the substrate 115, for example by allowing motion of the substrate supply mechanism 105.

Figure 4:
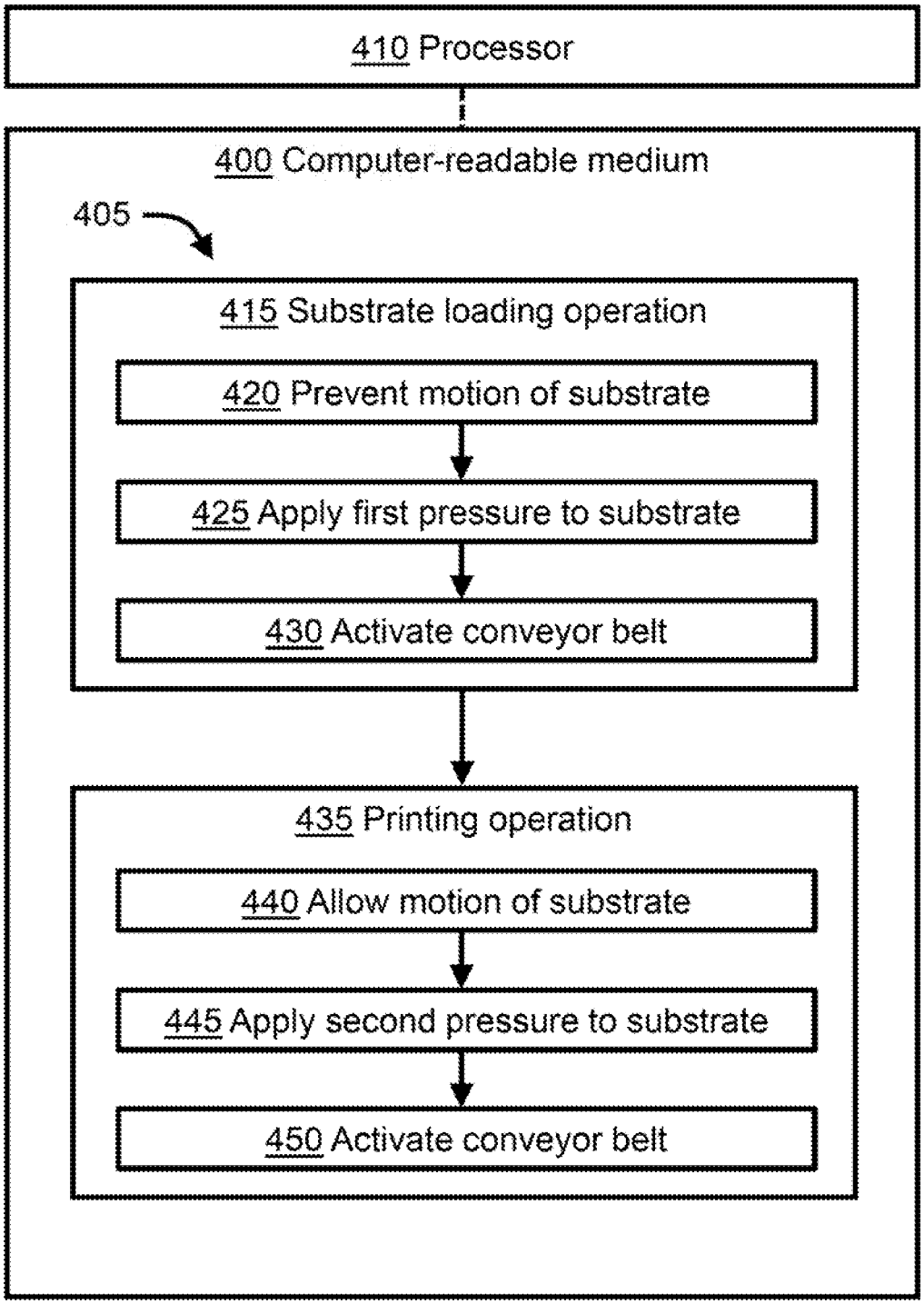
FIG. 4 shows a non-transitory computer-readable storage medium according to an example.

FIG. 4 shows an example of a non-transitory computer-readable storage medium 400 comprising a set of computer readable instructions 405 which, when executed by at least one processor 410 of a print system 100*a,b*, 200 comprising a print substrate supply mechanism 105 to supply print substrate 115 to a conveyor belt 110 where the conveyor belt 110 is to advance the supplied print substrate 115, cause the processor 410 to perform a method according to examples described herein. The computer readable instructions 405 may be retrieved from machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

The instructions 405 cause the processor 410 to control the printing system 100*a,b*, 200 to perform a substrate loading operation 415. The substrate loading operation 415 comprises preventing motion 420 of the supplied print substrate 115.

The substrate loading operation comprises applying 425 a first pressure to the supplied print substrate 115 to cause the supplied print substrate 115 to remain against the conveyor belt, for example as described in more detail above.

The substrate loading operation 415 then comprises activating 430 the conveyor belt 110. The first pressure allows the supplied print substrate 415 to slide over the conveyor belt 110. The conveyor belt 110 is then deactivated.

The instructions 405 cause the processor 410 to perform a printing operation 435. The printing operation 435 comprises allowing 440 motion of the supplied print substrate 115.

The printing operation 435 comprises applying 445 a second pressure, greater than the first pressure, to the supplied print substrate 115 to cause the supplied print substrate 115 to remain against the conveyor belt 110.

The printing operation 435 then comprises activating 450 the conveyor belt 110. As described in more detail above, the supplied substrate is advanced by the conveyor belt. In some examples, instead of deactivating the conveyor belt 110 following the first activation 430, the conveyor belt is activated 430 following application 325 of the first pressure and remains activated during the printing operation 435.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A printing system comprising:
a print substrate supply mechanism; and
a conveyor belt, wherein:
the print substrate supply mechanism is to supply print substrate to the conveyor belt,
the conveyor belt is to rotate upon being activated to advance the supplied print substrate when motion of the supplied print substrate is not prevented, and
during a substrate loading operation of the printing system, the print substrate supply mechanism prevents motion of the substrate once the supplied print substrate is positioned over the conveyor belt and prior to activation of the conveyor belt, and the conveyor belt is then subsequently activated to rotate, resulting in the supplied print substrate sliding over the conveyor belt due to the conveyor belt rotating while motion of the supplied print substrate is prevented.

2. The printing system of claim 1, comprising a pressure application mechanism to maintain the supplied substrate against the conveyor belt,
wherein, during the substrate loading operation, the pressure application device applies a first pressure such that when the conveyor belt is activated the supplied substrate slides over the conveyor belt.

3. The printing system of claim 2, wherein, during a printing operation of the printing system, the pressure application mechanism applies a second pressure, different from the first pressure, the second pressure being such that when the conveyor belt is activated the supplied substrate is advanced by the conveyor belt.

4. The printing system of claim 2, wherein the pressure application mechanism comprises a vacuum pump.

5. The printing system of claim 1, wherein, during a printing operation of the printing system, the print substrate supply mechanism allows motion of the substrate such that when the conveyor belt is activated the supplied substrate is advanced by the conveyor belt.

6. The printing system of claim 1, wherein, after the substrate loading operation and prior to a printing operation of the printing system, the print substrate supply mechanism applies a tensioning force to the supplied substrate to set tension of the supplied substrate to a tension suitable for the printing operation.

7. The printing system of claim 1, comprising a substrate position indicator to indicate a loading position for the substrate.

8. The printing system of claim 1, wherein the print substrate supply mechanism prevents motion of the substrate by engaging a locking element.

9. The printing system of claim 1, wherein:
the print substrate supply mechanism comprises a shaft to receive a substrate roll, the shaft being rotatable by a servo; and
the print substrate supply mechanism controls the servo to prevent motion of the substrate.

10. A method of operating a printing system, the printing system comprising a print substrate supply mechanism to supply print substrate to a conveyor belt, wherein the conveyor belt is to rotate upon being activated to advance the supplied print substrate when motion of the supplied print substrate is not prevented, the method comprising:
performing a substrate loading operation of the printing system, the substrate loading operation comprising:
once the supplied print substrate is in contact with and positioned over the conveyor belt, and prior to activation of the conveyor belt, preventing motion of the substrate and applying a first pressure to the supplied print substrate to cause the supplied print substrate to remain against the conveyor belt; and
subsequently activating the conveyor belt to rotate, resulting in the supplied print substrate sliding over the conveyor belt due to the conveyor belt rotating while motion of the supplied print substrate is prevented, and
performing a printing operation of the printing system, the printing operation comprising:
applying a second pressure, different from the first pressure, to the supplied print substrate to cause the supplied print substrate to remain against the conveyor belt; and
activating the conveyor belt, the second pressure being such that the supplied substrate is advanced by the conveyor belt.

11. The method of claim 10, wherein the first and second pressures are vacuum pressures.

12. The method of claim 10, comprising performing the substrate loading operation and printing operation in response to a user initiating a print job.

13. A non-transitory computer-readable storage medium comprising a set of computer-readable instructions stored thereon, which, when executed by a processor of a print system comprising a print substrate supply mechanism to supply print substrate to a conveyor belt, wherein the conveyor belt is to rotate upon being activated to advance the supplied print substrate when motion of the supplied print substrate is not prevented, cause the processor to control the printing system to:
perform a substrate loading operation comprising:
once the supplied print substrate is in contact with and positioned over the conveyor belt, and prior to activation of the conveyor belt, preventing motion of the substrate and applying a first pressure to the supplied print substrate to cause the supplied print substrate to remain against the conveyor belt; and subsequently activating the conveyor belt to rotate, resulting in the supplied print substrate sliding over the conveyor belt due to the conveyor belt rotating while motion of the supplied print substrate is prevented, and performing a printing operation comprising:

allowing motion of the supplied print substrate;

applying a second pressure, greater than the first pressure, to the supplied print substrate to cause the supplied print substrate to remain against the conveyor belt; and activating the conveyor belt, the second pressure being such that the supplied substrate is advanced by the conveyor belt.

* * * * *